US005739682A

United States Patent [19]

Kay

[11] Patent Number: 5,739,682

[45] Date of Patent: Apr. 14, 1998

[54] CIRCUIT AND METHOD FOR PROVIDING A REFERENCE CIRCUIT THAT IS SUBSTANTIALLY INDEPENDENT OF THE THRESHOLD VOLTAGE OF THE TRANSISTOR THAT PROVIDES THE REFERENCE CIRCUIT

[75] Inventor: Michael R. Kay, Richardson, Tex.

[73] Assignee: Texas Instruments Incorporated, Dallas, Tex.

[21] Appl. No.: 562,353

[22] Filed: Nov. 22, 1995

Related U.S. Application Data

[63] Continuation of Ser. No. 187,257, Jan. 25, 1994, abandoned.

[51] Int. Cl.[6] ..... G05F 3/26

[52] U.S. Cl. ..... 323/315; 327/538

[58] Field of Search ..... 323/315, 316; 327/530, 538, 539, 543

[56] References Cited

U.S. PATENT DOCUMENTS 4,399,374 8/1983 Boeke ..... 323/315

4,642,552 2/1987 Suzuki et al. ..... 323/315

*Primary Examiner*—Peter S. Wong

*Assistant Examiner*—Adolf Berhane

*Attorney, Agent, or Firm*—W. Daniel Swayze, Jr.; W. James Brady, III; Richard L. Donaldson

[57] ABSTRACT

A current source (10) for use on an integrated circuit chip (14), particularly in conjunction with CMOS circuits or the like, includes a first MOS transistor (12), having a gate to control a current in a current flow path therethrough. A second MOS transistor (13) having a gate to control a current in a current flow path therethrough between a supply voltage and a reference potential is connected to the gate of the first MOS transistor (12). A current source (16) is connected at a connection node to the first MOS transistor (12) to supply a current in the current flow path of the first MOS transistor (12) to hold the first MOS transistor (12) on. The gate of the first MOS transistor (12) is connected to the connection node. A bias voltage source ($V_B$) is provided in the current flow path of the first MOS transistor (12) with respect to the reference potential. With the circuit thus configured, the current flowing through the second MOS transistor (13) is essentially independent of the threshold voltage of the second MOS transistor (13). The MOS transistors can be either NMOS or PMOS transistors.

21 Claims, 2 Drawing Sheets

CIRCUIT AND METHOD FOR PROVIDING A REFERENCE CIRCUIT THAT IS SUBSTANTIALLY INDEPENDENT OF THE THRESHOLD VOLTAGE OF THE TRANSISTOR THAT PROVIDES THE REFERENCE CIRCUIT

This application is a Continuation of applicaiton Ser. No. 08/187,257 filed on Jan. 25, 1994 now abandoned.

BACKGROUND OF THE INVENTION

1. Field of the Invention

This invention relates to improvements in integrated circuits and methods, and more particularly to improvements in circuits and methods for providing a reference current in an integrated circuit, and still more particularly to improvements in circuits and methods for providing a reference current in MOS or CMOS type integrated voltage variations of the reference current providing transistors, and, consequently is substantially independent of fabrication process variations.

2. Relevant Background

In the fabrication of integrated circuits, and particularly MOS or CMOS integrated circuits to which this invention is especially suited, one or more reference current generators are commonly used for various circuit functions. A typical current generator is formed with a single MOS transistor that supplies a reference current in a current flow path between its source and drain.

More particularly, the current in a single MOS transistor used as a current source is proportional to the square of the gate-to-source voltage, $V_{gs}$, minus the threshold voltage, $V_t$, of the transistor:

$$I=k(V_{gs}-V_t)^2$$

As $V_t$ changes, so does the current I. It has been found, in fact, that due to process variations in integrated circuit fabrication, the value of $V_t$ can vary significantly, for example, ±25%, from circuit to circuit.

One of the ways this problem has been addressed in the past is to provide a $V_{gs}$ on chip that is large compared to $V_t$, so that variations in $V_t$ will be less significant. This method compromises design performance, including the dynamic range of the current source, and only works marginally well.

Another way this problem has been addressed is to have an off-chip $V_{gs}$ generator that can be adjusted or specially designed for each individual circuit. This approach requires that additional wires be bonded to the chip, and that an external voltage be supplied.

A third way this problem has been addressed is to provide an off-chip current to supply a reference current, $I_{REF}$, that can be mirrored to the necessary current sources. This approach also requires additional external wires and voltages.

SUMMARY OF THE INVENTION

In light of the above, it is therefore an object of the invention to provide an improved current source circuit.

It is another object of the invention to provide an improved current source circuit that can be used in conjunction with MOS and CMOS integrated circuits.

It is another object of the invention to provide an improved CMOS current source circuit of the type described that provides an on-chip current reference and that is self adjusting to correct for integrated circuit processing variations.

It is another object of the invention to provide a self-adjusting current source of the type described that does not require off chip voltage or current references and does not increase the complexity of wiring to the chip.

It is an advantage of the invention that increased production yields and circuit performance can be achieved without significantly increasing production costs.

These and other objects, features, and advantages will become apparent to those skilled in the art from the following detailed description, when read in conjunction with the accompanying drawings and appended claims.

Thus, in accordance with a broad aspect of the invention, a current source is provided on an integrated circuit chip. The current source includes a first MOS transistor, which has a gate to control a current in a current flow path therethrough. A second MOS transistor, which has a gate to control a current in a current flow path therethrough, regulates a current between a supply voltage and a reference potential. The gate of the first and second MOS transistors are connected together. A current source is connected at a connection node to the first MOS transistor to supply a current in the current flow path of the first MOS transistor to hold the first MOS transistor on. The gate of the first MOS transistor is connected to the connection node. A bias voltage source also is provided in the current flow path of the first MOS transistor with respect to the reference potential. With the circuit thus configured, the current flowing through the second MOS transistor is substantially independent of the threshold voltage of the second MOS transistor. The MOS transistors can be either NMOS or PMOS transistors.

According to another broad aspect of the invention, a current source is fabricated on an integrated circuit chip to provide a reference current that is essentially independent of a threshold voltage of a reference current controlling MOS transistor. The circuit includes a first MOS transistor, having a gate to control a current in a current flow path therethrough. A current source is connected at a connection node to the first MOS transistor to supply a current in the current flow path of the first MOS transistor to hold the first MOS transistor on. The gate of the first MOS transistor is connected to the connection node. A voltage source provides a bias voltage in the current flow path of the first MOS transistor with respect to a reference potential. A gate of the reference current controlling MOS transistor is connected to the gate of the first MOS transistor, whereby the current flowing through the reference current controlling MOS transistor mirrors the current in the flow path of the first MOS transistor and is substantially independent of the threshold voltage of the reference current controlling MOS transistor.

According to still another broad aspect of the invention, a method is presented for providing a reference current to an integrated circuit of the type in which an MOS transistor provides a reference current in a current path that is controlled by a voltage on a gate element of the transistor. The method includes the step of generating a bias voltage that has a voltage component of magnitude substantially equal to a threshold voltage of the MOS transistor and that is of opposite polarity from the threshold voltage of the MOS transistor. The method includes the further step of applying the bias voltage to the gate element of the MOS transistor, whereby the bias voltage component is subtracted from the threshold voltage of the MOS transistor, and wherein the reference current is substantially independent of the threshold voltage.

BRIEF DESCRIPTION OF THE DRAWINGS

The invention is illustrated in the accompanying drawings, in which.

DETAILED DESCRIPTION OF THE PREFERRED EMBODIMENTS

Figure 1:
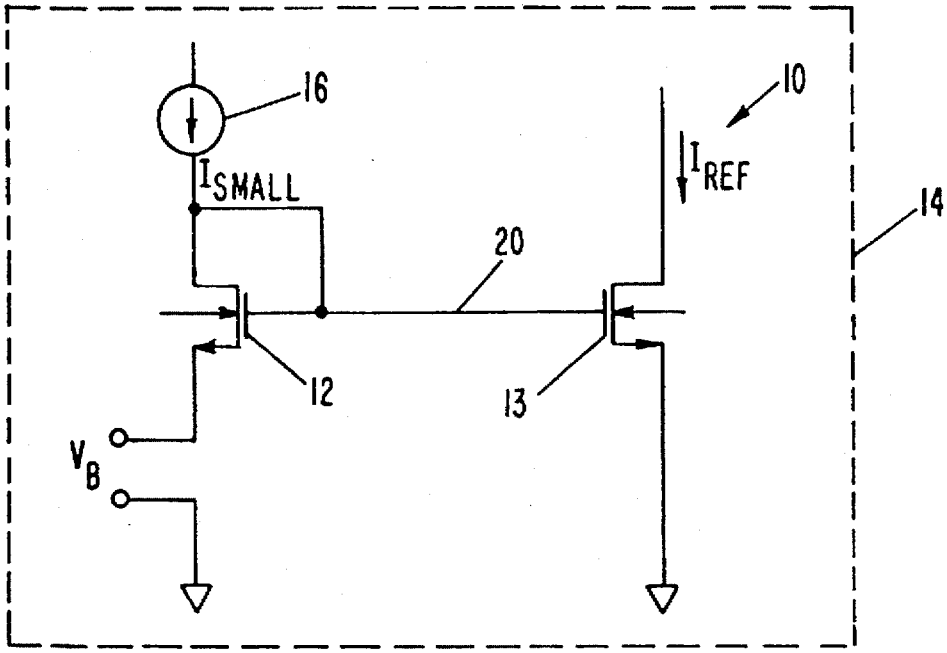
FIG. 1 is an electrical schematic diagram of a current source in accordance with a preferred embodiment of the invention.

An electrical schematic diagram of a current source circuit 10, in accordance with a preferred embodiment of the invention, is shown in FIG. 1. Although the circuit 10 is described in conjunction with MOS or CMOS type circuitry, in particular, it will be appreciated that the circuit 10 can be used with essentially all analog circuit designs, since almost all analog designs require the use of accurate current sources. For example, the circuit 10 is useful in almost any ASIC design or off-the-shelf analog circuit design. The circuit 10 has two MOS transistors 12 and 13 of similar design that have preferably been laid out together on a portion of a semiconductor substrate 14 in order to have similar electrical characteristics. It should be noted that although the transistors 12 and 13 are shown as being NMOS type devices, PMOS type devices can be equally advantageously employed.

The MOS transistor 13 is connected to provide a current flow path to a reference potential, or ground, providing the reference current, $I_{REF}$, therethrough. Similarly, the MOS transistor 12 is connected between a voltage supply (not shown) and the reference potential, or ground, through a current source 16 between the drain and supply voltage, and through a voltage source $V_B$ between the source and the reference potential, or ground. The gate of the MOS transistor 12 is connected to the gate of the MOS transistor 13, as well as to the drain of the MOS transistor 12.

As will become apparent, the magnitude of the current supplied from the current source 16 is of little significance; its purpose is to maintain the MOS transistor 12 on, or in a conducting state. Thus the magnitude of the current provided by the current source 16 can be very small. Similarly, the value of the voltage $V_B$, which establishes the voltage on the gate of the reference current generating MOS transistor 13 can be set by the designer according to the particular needs of the circuit.

As mentioned above, the current in a single MOS transistor used as a current source is proportional to the square of the gate-to-source voltage minus the threshold voltage of the transistor. The voltage on the node 20 is therefore:

$$V_{node20} = V_{gs-13} = V_B + V_t + \sqrt{\frac{2I_{SMALL}}{k'\left(\frac{W}{L}\right)}},$$

where W is the width and L is the length of the channel, and $V_t$ is the threshold voltage of the transistor 12.

On the other hand, the current $I_{REF}$ is:

$$I_{REF}=(k'/2)(W/L)(V_{gs}-V_t)^2$$

Substituting:

$$I_{REF}=\left(\frac{k'}{2}\right)\left(\frac{W}{L}\right)\left(V_B+V_t-V_t+\sqrt{\frac{2I_{small}}{k'\left(\frac{W}{L}\right)}}\right)^2$$

Thus, if the term $$\sqrt{\frac{2I_{small}}{k'\left(\frac{W}{L}\right)}}$$

is made small, $$I_{REF}=(k'/2)(W/L)(V_B)^2$$

which is substantially independent of $V_t$.

As can be seen, the circuit 10 operates to substantially eliminate the dependency of the current, $I_{REF}$, on variations in the threshold voltage, $V_t$, since the threshold voltage $V_t$ has canceled, leaving the current $I_{REF}$ a function just of $V_B$. SPICE simulations have shown that the variations in current due to $V_t$ shifts are about seven times more significant than all other model parameters combined. So, using the design technique in the fabrication of a circuit 10 of the invention yields a current source with a seven times tighter deviation than heretofore achieved.

Figure 2:
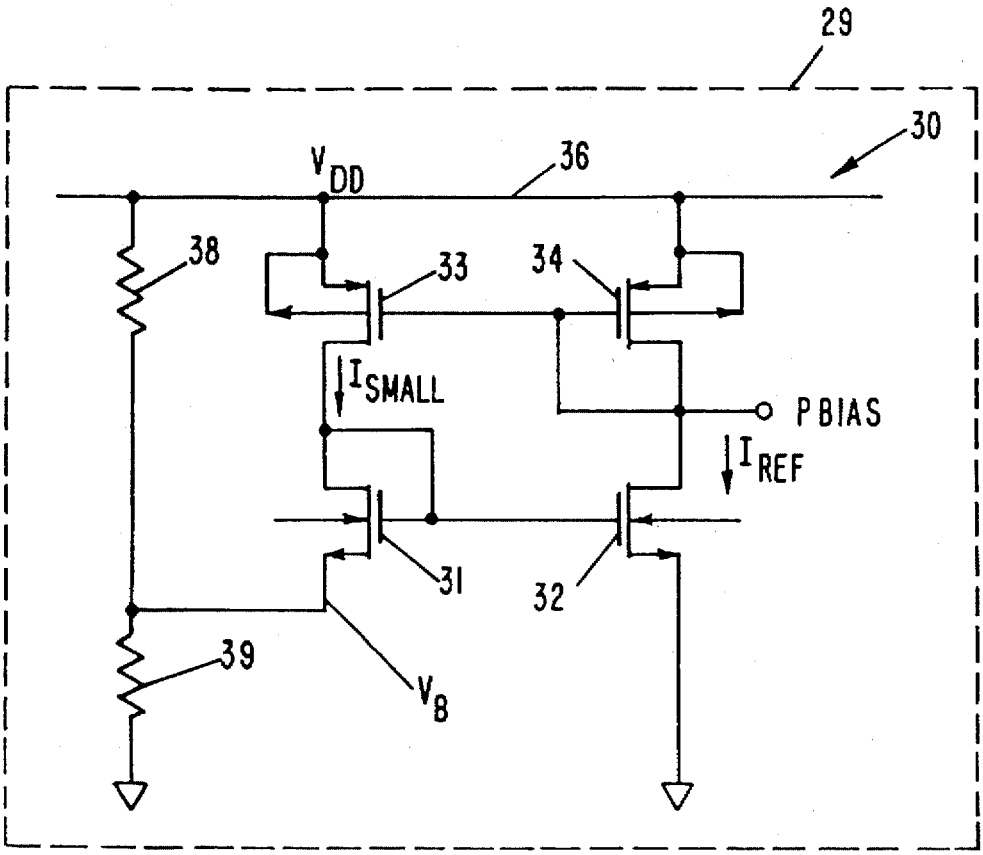
FIG. 2 is an electrical schematic diagram of the current source of FIG. 1, together with supporting bias voltage and current sources, integrated onto a semiconductor chip.

An electrical schematic diagram of the current source of FIG. 1 together with supporting bias voltage and current sources, integrated onto a semiconductor substrate 29 is shown in FIG. 2. The circuit 30 includes a first and second NMOS transistors 31 and 32, which serve similar functions to the respective NMOS transistors 12 and 13 described above with respect to the circuit of FIG. 1. In addition, the circuit 30 includes two PMOS transistors 33 and 34 having current flow paths respectively in series with the current flow paths of the NMOS transistors 31 and 32 to the supply rail 36. It can be seen that the current, $I_{REF}$, flowing in the NMOS transistor 32 will be mirrored by the PMOS transistor 33, and the mirrored current can be sized by adjusting the W/L ratio of the PMOS transistors 33 and 34. The bias voltage $V_B$ is established on the source of the NMOS transistor 31 by a voltage divider that includes resistors 38 and 39.

Although the W/L ratio of the various transistors can be adjustably varied depending upon the particular application in which the circuit 30 is used, it has been found that preferred W/L ratios that achieve satisfactory results are approximately as set forth in the following table:

| Transistor | 31 | 32 | 33 | 34 |
|---|---|---|---|---|
| W/L ratio | 10/33 | 10/33 | 6/60 | 40/10 |

Interestingly, a ratio of 9.58/25 for the NMOS transistors 31 and 32 has been found to provide good results in the the production of a reference current $I_{REF}$ that is independent of $V_t$. It should also be noted that if the W/L ratios of both NMOS transistors 31 and 32 are made substantially the same, their $V_t$ characteristics can be made to substantially match, which is preferred.

Figure 3:
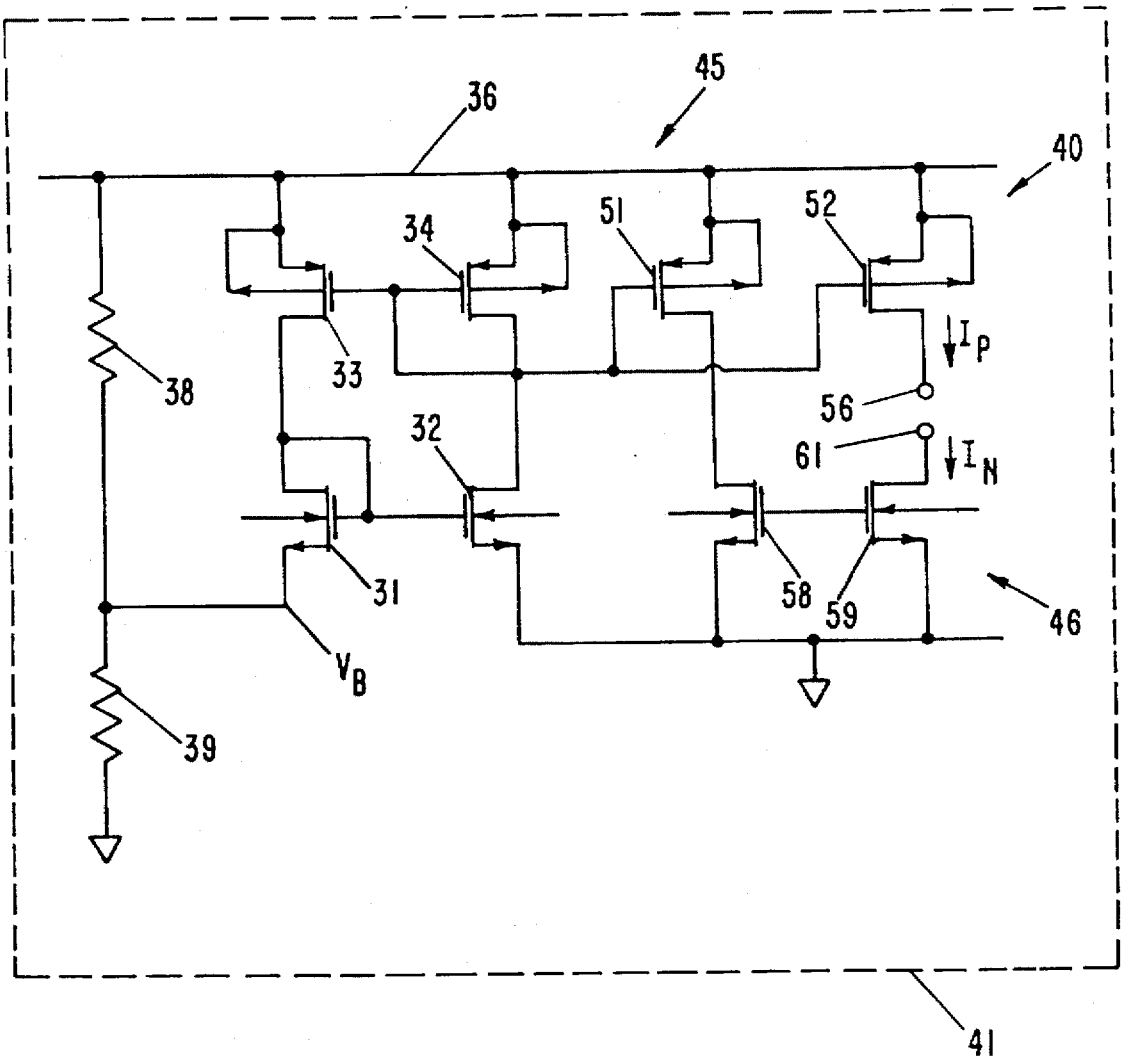
FIG. 3 is an electrical schematic diagram of a circuit, in accordance with a preferred embodiment of the invention, based upon the circuit of FIG. 2, for sinking and sourcing reference currents.

An electrical schematic diagram of a circuit 40, in accordance with a preferred embodiment of the invention, based upon the circuit of FIG. 2, for sinking and sourcing reference currents is shown in FIG. 3. In the circuit of FIG. 3, parts corresponding to similar parts in the circuit of FIG. 2 are denoted with the same reference numerals. In the circuit of FIG. 3, which can be integrated onto a semiconductor substrate 41, current mirrors 45 and 46 are provided to mirror the current in the current flow path of the NMOS transistor 32 for output. The current mirror 45 includes two PMOS transistors 51 and 52 to connected to produce an output current, $I_P$, on a first output terminal 56. Similarly, the current mirror 46 includes NMOS transistors 58 and 59 connected to sink a current, $I_N$, at a second output terminal 61. The magnitudes of the output currents $I_P$ and $I_N$ can be adjusted as needed by adjusting the W/L ratios of the various mirror transistors 51–52 and 58–59. For example, one set of W/L ratios that can be employed is set forth in the following table:

| Transistor | 31 | 32 | 33 | 34 | 51 | 52 | 58 | 59 |
|---|---|---|---|---|---|---|---|---|
| W/L ratio | 10/33 | 10/33 | 6/60 | 40/10 | 20/10 | 20/10 | 20/10 | 10/10 |

The output currents available on terminals 56 and 61 can be used for any circuit use, such as to provide current for source followers, operational amplifiers, or other circuitry.

Although the invention has been described and illustrated with a certain degree of particularity, it is understood that the present disclosure has been made only by way of example, and that numerous changes in the combination and arrangement of parts can be resorted to by those skilled in the art without departing from the spirit and scope of the invention, as hereinafter claimed.

I claim:

1. A current source on a single integrated circuit chip, comprising;

a first transistor, having a first element to control a first current in a first current flow path therethrough;

a second transistor, having a second element to control a second current in a second current flow path therethrough between a supply voltage of the current source and a reference potential of the current source, and connected to the first element of said first transistor;

a current source connected at a node to said first transistor to supply the first current in the first current flow path of said first transistor to hold said first transistor on;

the first element of said first transistor being connected to said node;

and a source providing a bias voltage in the current flow path of said first transistor with respect to the reference potential;

wherein the second current flowing through the second transistor is independent of a threshold voltage of the second transistor.

2. The current source of claim 1 wherein said first and second transistors are MOS transistors.

3. The current source of claim 2 wherein said first and second MOS transistors are NMOS transistors.

4. The current source of claim 2 wherein said first and second MOS transistors are PMOS transistors.

5. The current source of claim 3 wherein said current source further comprises a first PMOS transistor having a current flow path in series with the first current flow path of said first transistor.

6. The current source of claim 5, wherein the current source further comprises a second PMOS transistor having a current flow path in series with the second current flow path of said second transistor, and having a current control element connected to a current control element of said first PMOS transistor, wherein said reference current is mirrored by said first PMOS transistor to provide said current in the current flow path of said first transistor to hold said first transistor on.

7. The current source of claim 1 wherein said source providing a bias voltage in the current flow path of said first transistor comprises a resistor voltage divider connected between said supply voltage and reference potential.

8. A current source fabricated on a single integrated circuit chip for providing a reference current that is essentially independent of a threshold voltage of a reference current controlling MOS transistor, comprising;

a first MOS transistor, having a gate to control a first current in a first current flow path therethrough;

a current source connected at a node to said first MOS transistor to supply a current in the first current flow path of said first MOS transistor to hold said first MOS transistor on;

the gate of said first MOS transistor being connected to said node;

a voltage source for providing a bias voltage in the first current flow path of said first MOS transistor with respect to a reference potential of the current source;

a gate of said reference current controlling MOS transistor being connected to the gate of said first MOS transistor, wherein a voltage on the gate of said first MOS transistor has a factor representing a magnitude substantially equal to a threshold voltage of the reference current controlling MOS transistor, and of opposite polarity, wherein the reference current is independent of the threshold voltage of said reference current controlling MOS transistor.

9. The current source of claim 8 wherein said first and second MOS transistors are NMOS transistors.

10. The current source of claim 8 wherein said first and second MOS transistors are PMOS transistors.

11. The current source of claim 8 further comprising a first current mirror to provide a first output reference current that is mirrored from said reference current of said reference current controlling MOS transistor.

12. The current source of claim 11 further comprising a second current mirror to provide a second output reference current that is mirrored from said reference current of said reference current controlling MOS transistor.

13. The current source of claim 12 wherein said first current mirror is connected to source said first output reference current, and said second current mirror is connected to reduced said second output reference current.

14. The current source of claim 8 wherein said current source comprises a first PMOS transistor having a current flow path in series with the current flow path of said first transistor.

15. The current source of claim 14 further comprising a second PMOS transistor having a current flow path in series with the current flow path of said second transistor, and having a current control element connected to a current control element of said first PMOS transistor, wherein said reference current is mirrored by said first PMOS transistor to provide said current in the current flow path of said first transistor to hold said first transistor on.

16. The current source of claim 15 wherein said second PMOS transistor has a channel that has a width to length ratio that is sized with respect to a width to length ratio of a channel of said first PMOS transistor wherein said current in the current flow path of said first transistor to hold said first transistor on is small with respect to said reference current.

17. A method for providing a reference current to an integrated circuit in which a first MOS transistor provides a reference current in a current path that is controlled by a voltage on a gate element, comprising:

generating a bias voltage that has a voltage component of magnitude substantially equal to a threshold voltage of said first MOS transistor and that is of opposite polarity from the threshold voltage of said first MOS transistor; and applying said bias voltage to the gate element of said first MOS transistor, whereby said bias voltage component is subtracted from the threshold voltage of said first MOS transistor, and wherein the reference current is independent of the threshold voltage.

18. The method of claim 17 wherein said step of generating the bias voltage includes: providing a current path in a second MOS transistor that is constructed similarly to said first MOS transistor; providing a current in said current path of said second MOS transistor to hold said second MOS transistor on; and establishing a bias voltage on said second MOS transistor to raise a control element of said second MOS transistor, which is connected to the control element of said first MOS transistor, to a voltage that has a voltage component of magnitude substantially equal to a threshold voltage of said first MOS transistor and that is of opposite polarity from the threshold voltage of said first MOS transistor.

19. The method of claim 18 wherein said step of establishing a bias voltage on said second MOS transistor comprises providing a resistor voltage divider between a supply voltage and a reference voltage, and connecting said voltage divider to said control element of said second MOS transistor.

20. The method of claim 17 further comprising providing an output current mirror circuit connected to mirror the reference current to an output terminal.

21. The method of claim 17 further comprising providing two output current mirror circuits, each connected to mirror the reference current to an output terminal, one of said current mirror circuits being connected to source an output current that is mirrored from said reference current and another of said current mirror circuits being connected to sink an output current that is mirrored from said reference current.

* * * * *